United States Patent [19]

Cale

[11] 4,194,599

[45] Mar. 25, 1980

[54] RAILWAY CAR BRAKE BEAM LEVER MOUNTING

[75] Inventor: Roland E. Cale, Cortland, Ohio

[73] Assignee: Schaefer Equipment Incorporated, Warren, Ohio

[21] Appl. No.: 919,661

[22] Filed: Jun. 27, 1978

[51] Int. Cl.[2] ..... B61H 13/36

[52] U.S. Cl. ..... 188/231; 188/52

[58] Field of Search ..... 188/49, 50, 51, 52, 188/53, 54, 55, 229.1, 229.6, 231, 232, 233, 207, 208, 212, 214

[56] References Cited

U.S. PATENT DOCUMENTS

| | | | |
|---|---|---|---|
| 638,638 | 12/1899 | Lawler | 188/229.6 |
| 800,409 | 9/1905 | Sharp | 188/232 |
| 1,140,089 | 5/1915 | Whitney | 188/231 |
| 2,431,914 | 12/1947 | Brown | 188/229.1 |

FOREIGN PATENT DOCUMENTS

| | | | |
|---|---|---|---|
| 6820 | of 1915 | United Kingdom | 188/207 |

*Primary Examiner*—George E. A. Halvosa
*Attorney, Agent, or Firm*—Brown, Flick & Peckham

[57] ABSTRACT

A brake beam lever extends through an inclined slot in a brake beam strut at a greater inclination to vertical than the slot, and wedge shape members fill the wedge shape spaces formed between the lever and the side walls of the slot. A pivot pin extends through said strut and wedge members and lever, and the ends of the lever are provided with openings for clevis pins.

1 Claim, 3 Drawing Figures

RAILWAY CAR BRAKE BEAM LEVER MOUNTING

A typical railway car brake beam has a slotted central strut in which the central portion of a brake lever is pivotally mounted. One end of the lever is connected to a top or bottom rod extending across the truck bolster to the lever of the opposing brake beam. The opposite end of one of the levers is connected by a rod to an anchor point on the car, while the corresponding end of the other lever is connected by a rod to the brake actuating mechanism. Such brake levers are inclined lengthwise of the brake beams a certain number of degrees, usually about 40°, from the vertical. One thing that this inclination does is to lower the upper end of the lever relative to the position it would occupy if the lever were vertical. Nevertheless, with modern freight cars, the typical inclination of a brake lever often is not enough to prevent the movements of the upper end of the lever from being interfered with by the bottom of the car body, especially when the car body is mounted on springs that permit several inches of vertical movement of the body. Therefore, to provide the necessary clearance, the major portion of the lever above the strut has been inclined to a greater extent than its intermediate portion that extends through the strut. This lowers the upper end of the lever so that its movements will not be obstructed. However, another problem is created by such a lever. Due to the lever not being straight from end to end, the brake rods connected to its opposite ends pull on it in such a way as to tend to cause it to twist and thereby bind in the strut, which is a very undesirable condition.

It is an object of this invention to provide a brake lever that has sufficient operating clearance and yet will not bind in a brake beam strut during operation, which is thinner than those now in use, and which is straight.

The preferred embodiment of the invention is illustrated in the accompanying drawings, in which FIG. 1 is a side view showing a pair of brake levers mounted in brake beams indicated in dotted lines;

Figure 1:
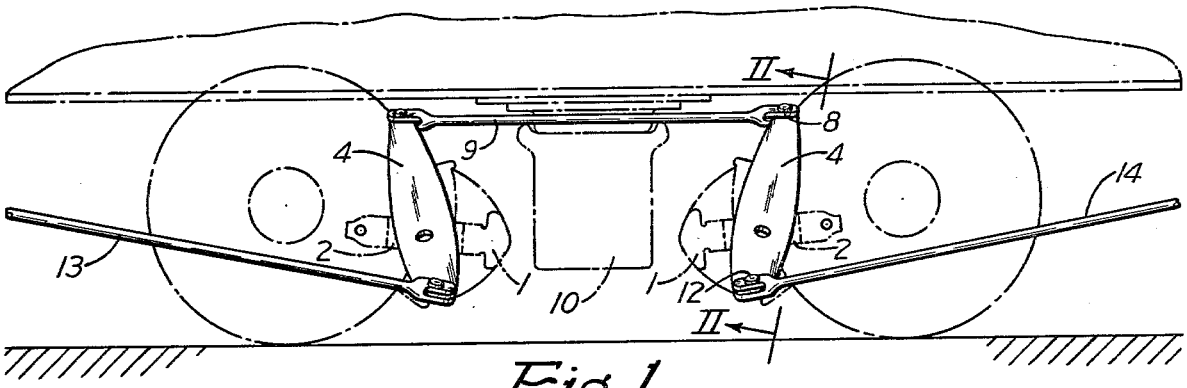
Figure 2:
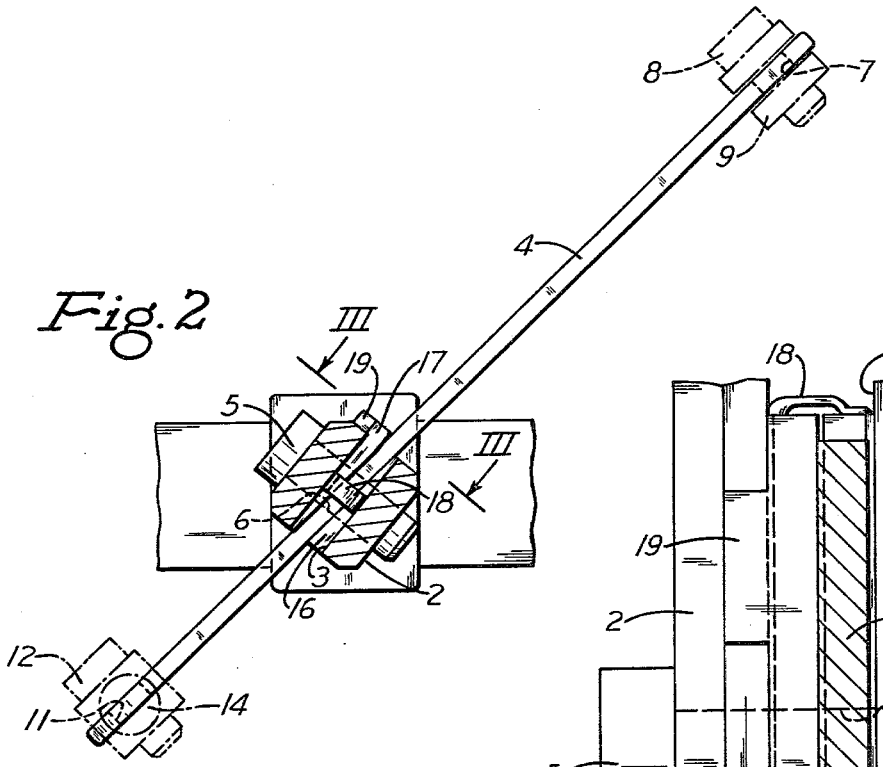
FIG. 2 is an enlarged vertical section taken on the line II—II of FIG. 1.
Figure 3:
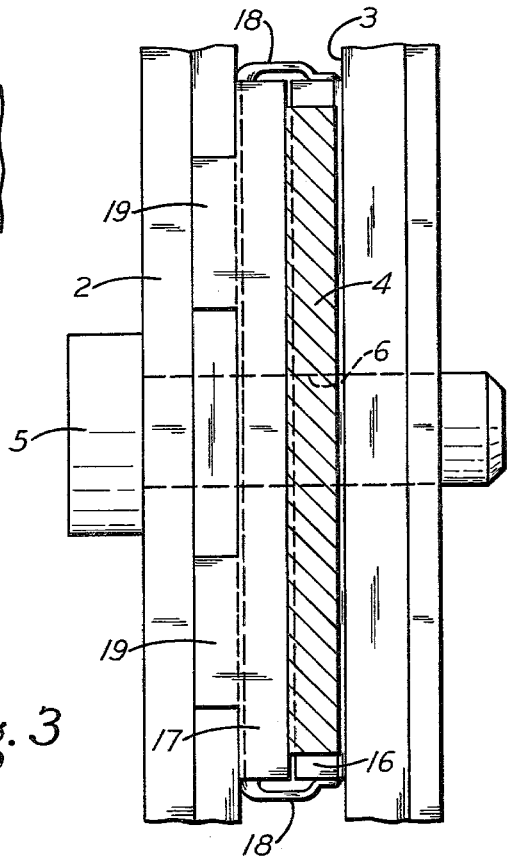
FIG. 3 is a cross section of the lever taken on the line III—III of FIG. 2.

Referring to FIGS. 1 and 2 of the drawings, a railway car truck is provided with a pair of brake beams 1 of conventional construction, each of which includes a central strut 2 extending lengthwise of the car and provided with a laterally inclined slot 3 theretrhough as shown in FIG. 2. The slot has parallel side walls. In practice, the angle of the slot generally is about 40° from vertical. Extending through the strut slot is a brake lever 4. The lever is held in place by a pivot pin 5 extending through the strut and an opening 6 in the lever.

The upper end of the lever is provided with an opening 7, through which extends a pivot pin 8 that attaches to the lever the clevis of a connecting rod, such as a top rod 9 extending through the bolster 10 of the truck. There likewise is an opening 11 through the lower end of the lever for receiving a pivot pin 12 that connects the clevis of a brake rod to the lever. If the lever being considered is the dead lever, the rod 13 extends from it to an anchor point on the car. If it is the live lever, the rod 14 connects it with the mechanism for applying the brakes.

It is a feature of this invention that, although the lever is straight from end to end, it is inclined from the vertical more than the slot through the strut, whereby to lower its upper end as much as possible. To permit this to be done, the lever is considerably thinner than the width of the slot. Preferably, the thickness of the lever is equal to about half the width of the slot. Since the lever is inclined relative to the slot, wedge shape spaces are formed between the lever and the side walls of the slot. The widest part of the space above the lever is at the top of the strut, while the widest part of the space below the lever is at the bottom of the strut. These two spaces are substantially filled by a pair of wedge shape members 16 and 17 through which the pivot pin also extends. The ends of these members project a short distance beyond the opposite edges of the lever, and the ends of one wedge are connected to the adjacent ends of the other wedge by cross pieces 18 spaced from said lever and located along a minor length of said ends midway between the upper and lower edges of said side walls. These cross pieces may be formed integrally with one wedge and then bent at right angles and welded to the other wedge. The spacing of the two wedges is such that their outer faces will substantially engage the side walls of the strut, but their inner faces will be spaced apart a distance slightly greater than the thickness of the lever in order to provide the desired clearance for movement of the lever around the pivot pin.

To help hold the wedges in place so that they will not tend to turn with the lever, the upper wedge 17 may be provided at its top with laterally projecting lugs 19 that overlie and engage the top of the upper wall of the strut slot. Since the pivot pin extends through the strut at right angles to it, the lever will be inclined relative to the pin and therefore the opening through the lever will be inclined to the longitudinal plane of the lever. However, the pin openings in the opposite ends of the lever will generally be perpendicular to the lever.

It will be seen that with this construction the upper end of the lever will be at a lower level than the upper end of a conventional straight lever that is inclined at the same angle as the strut slot. Yet, the lever can be perfectly straight. Also, it can have a simple form with flat sides and uniform thickness from end to end.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. The combination with a railway car brake beam provided with a strut having a slot therethrough with parallel side walls inclined a predetermined number of degrees from vertical, of a brake lever extending through said slot and inclined from vertical more than the slot, whereby wedge shape spaces are formed between the lever and the side walls of the slot, a wedge shape member having ends extending in the direction of the lever's length substantially filling each of said spaces, a pivot pin extending through said strut and wedge members and lever for connecting the lever to the strut, and a cross piece at each end of said wedge members extending across the lever in spaced relation therewith and rigidly connecting the wedge members to each other, the cross pieces being located along a minor length of the ends midway between the upper and lower edges of said side walls and spaced therefrom, one of said wedge members being provided with means overlapping the top of the adjoining side of the strut in engagement therewith to avoid turning of the wedge members by the lever, and each end of the lever having an opening therethrough for a clevis pin.

* * * * *